US008943629B2

(12) United States Patent
Paul et al.

(10) Patent No.: US 8,943,629 B2
(45) Date of Patent: Feb. 3, 2015

(54) WASHING SYSTEM AND METHOD FOR LOAD SIZE AND WATER RETENTION DETECTION

(75) Inventors: Steven D. Paul, Louisville, KY (US); Christopher G. Hoppe, Louisville, KY (US); Craig Vitan, Louisville, KY (US); Steven Recio, Louisville, KY (US); Carl W. Risen, Louisville, KY (US); Russell Katona, Cleveland, OH (US)

(73) Assignee: General Electric Company, Schenectady, NY (US)

( * ) Notice: Subject to any disclaimer, the term of this patent is extended or adjusted under 35 U.S.C. 154(b) by 235 days.

(21) Appl. No.: 12/341,329

(22) Filed: Dec. 22, 2008

(65) Prior Publication Data

US 2010/0154131 A1 Jun. 24, 2010

(51) Int. Cl.
*D06F 39/00* (2006.01)

(52) U.S. Cl.
CPC ..... *D06F 39/003* (2013.01); *D06F 2202/065* (2013.01); *D06F 2220/00* (2013.01)
USPC ..... 8/159; 8/158

(58) Field of Classification Search
CPC ..... D06F 35/006
See application file for complete search history.

(56) References Cited

U.S. PATENT DOCUMENTS

| | | | | |
|---|---|---|---|---|
| 5,507,055 | A * | 4/1996 | Blauert et al. | 8/159 |
| 6,038,724 | A | 3/2000 | Chbat et al. | |
| 2004/0163183 | A1* | 8/2004 | Kim | 8/137 |
| 2006/0200255 | A1* | 9/2006 | Cenedese et al. | 700/20 |
| 2006/0265897 | A1 | 11/2006 | Jeong et al. | |
| 2007/0193310 | A1 | 8/2007 | Penteado et al. | |
| 2007/0261177 | A1 | 11/2007 | Risen et al. | |
| 2008/0041115 | A1 | 2/2008 | Kanazawa et al. | |

* cited by examiner

*Primary Examiner* — Jason Ko
(74) *Attorney, Agent, or Firm* — Fay Sharpe LLP

(57) ABSTRACT

A washing system and method for load size and water retention detection includes a cabinet, a tub position within the cabinet, a basket with a wash load received therein rotatably supported within the tub, and a drive system for rotating the basket. A controller is operatively coupled to the drive system. The controller rotates the rotatable basket to urge the wash load radially outwardly in the basket and then decelerates the rotatable basket with the wash load urged radially outwardly to or below a predetermined threshold speed. An amount of time from initial deceleration of the rotatable basket until the rotatable basket is at or below the predetermined threshold speed is measured and the measured amount of time is used to determine a parameter of the wash load.

11 Claims, 4 Drawing Sheets

WASHING SYSTEM AND METHOD FOR LOAD SIZE AND WATER RETENTION DETECTION

BACKGROUND

The present disclosure generally relates to washing machines, and more particularly relates to a washing system and method for load size detection and optionally water retention detection.

Washing machines typically include a cabinet which receives a stationary tub for containing wash and rinse water. A wash basket is rotatably mounted within the wash tub, and an agitating element is rotatably positioned within the wash basket. A drive assembly and a brake assembly can be positioned with respect to the wash tub and configured to rotate and control the agitation of the wash basket to cleanse the wash load loaded into the wash basket. Upon completion of a wash cycle, a pump assembly can be used to rinse and drain the soiled water to a draining system.

One important parameter of the wash load is the load size, which is preferably related to the amount of water and laundry additives (e.g., detergent, fabric softener, etc.) used during or in connection with the wash cycle. For example, large wash loads are preferably washed with larger quantities of water and detergent than comparatively smaller wash loads. When the proper amounts of wash water and laundry additives are used for a given wash load, the washing action of the wash load is improved and there is less waste (e.g., water, detergent, etc.). In addition, significant energy savings can be achieved because no excess or unnecessary water is heated and/or a lower load is seen by the motor that imparts motion to the wash load.

SUMMARY

According to one aspect, a method for determining a parameter of a wash load held in a rotatable basket of a washing machine is provided. More particularly, in accordance with this aspect, the rotatable basket is rotated to urge the wash load radially outwardly in the basket. The rotatable basket with the wash load urged radially outwardly is decelerated to or below a predetermined threshold speed. An amount of time from initial deceleration of the rotatable basket until the rotatable basket is at or below the predetermined threshold speed is measured. The measured amount of time is used to determine a parameter of the wash load.

According to another aspect, a washing machine is provided. More particularly, in accordance with this aspect, the washing machine includes a cabinet, a tub positioned within the cabinet, a basket with a wash load received therein rotatably supported within the tub, and a drive system drivingly connected to the basket for rotating the basket. The washing machine further includes a controller operatively coupled to the drive system. The controller is configured to operate the drive system to accelerate rotation of the basket to a first speed and then decelerate rotation of the basket from the first speed to a second, lower speed. The controller is further configured to measure an amount of time of deceleration from the first speed to the second speed to determine a parameter of the wash load.

According to still another aspect, a method for determining load size of a wash load in a washing machine is provided. More particularly, in accordance with this aspect, a rotatable basket with a wash load held therein is rotated at a first speed to urge the wash load radially outwardly. The rotatable basket with the wash load urged radially outwardly is decelerated from the first speed to a second, lower speed. An amount of time of deceleration of the rotatable basket from the first speed to the second speed is measured. The measured amount of time is correlated to a weight of the wash load.

DETAILED DESCRIPTION

Figure 1:
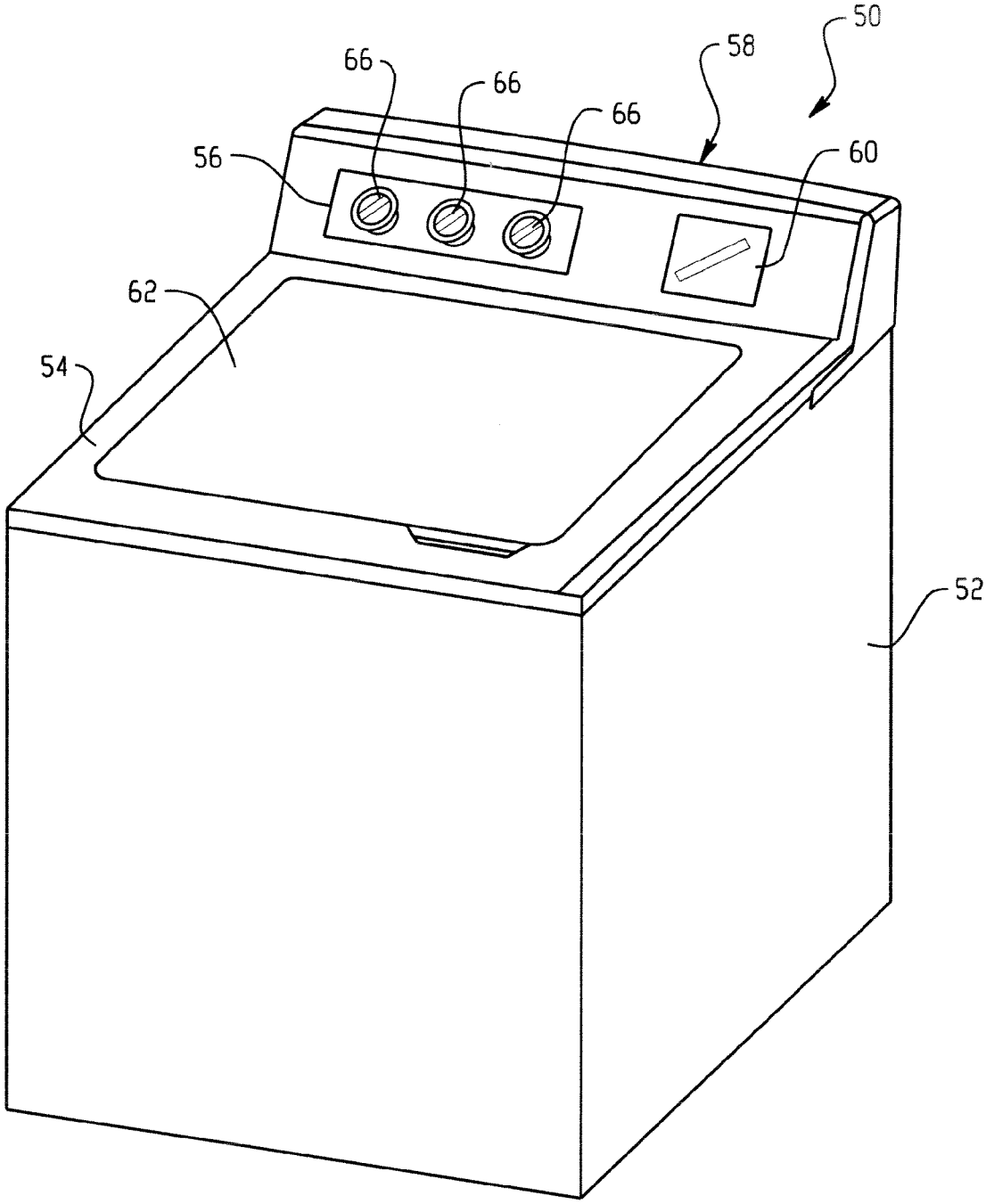
FIG. 1 is a perspective view of a washing machine.

Referring now to the drawings wherein the showings are for purposes of illustrating one or more exemplary embodiments, FIG. 1 shows a washing system or machine generally designated by reference numeral 50. As will be described in further detail below, the washing system or machine 50 can detect a wash load size and optionally can detect a degree of water retention within a wash load. In the embodiment illustrated in FIG. 1, the washing machine 50 is depicted as a vertical axis washing machine, however, it is to be understood and appreciated by those skilled in the art that the machine 50 could alternatively be a horizontal axis washing machine or some other type of washing machine.

The illustrated washing machine 50 includes a cabinet 52 and a cover 54. A backsplash 58 extends from the cover 54, and a control panel 56 including a plurality of input selectors 66 is coupled to the backsplash 58. As is known and understood by those skilled in the art, the control panel 56 and the input selectors 66 can collectively form a user interface input for operator selection of machine cycles and features. A display 60 can indicate the selected features, a countdown timer, and/or other items of interest to machine users. A lid 62 is mounted to the cover 54 and is pivotable about a hinge (not shown) between an open position facilitating access to a wash tub 64 (FIG. 2) located within the cabinet 52, and a closed position (as shown) forming an enclosure over the wash tub 64.

Figure 2:
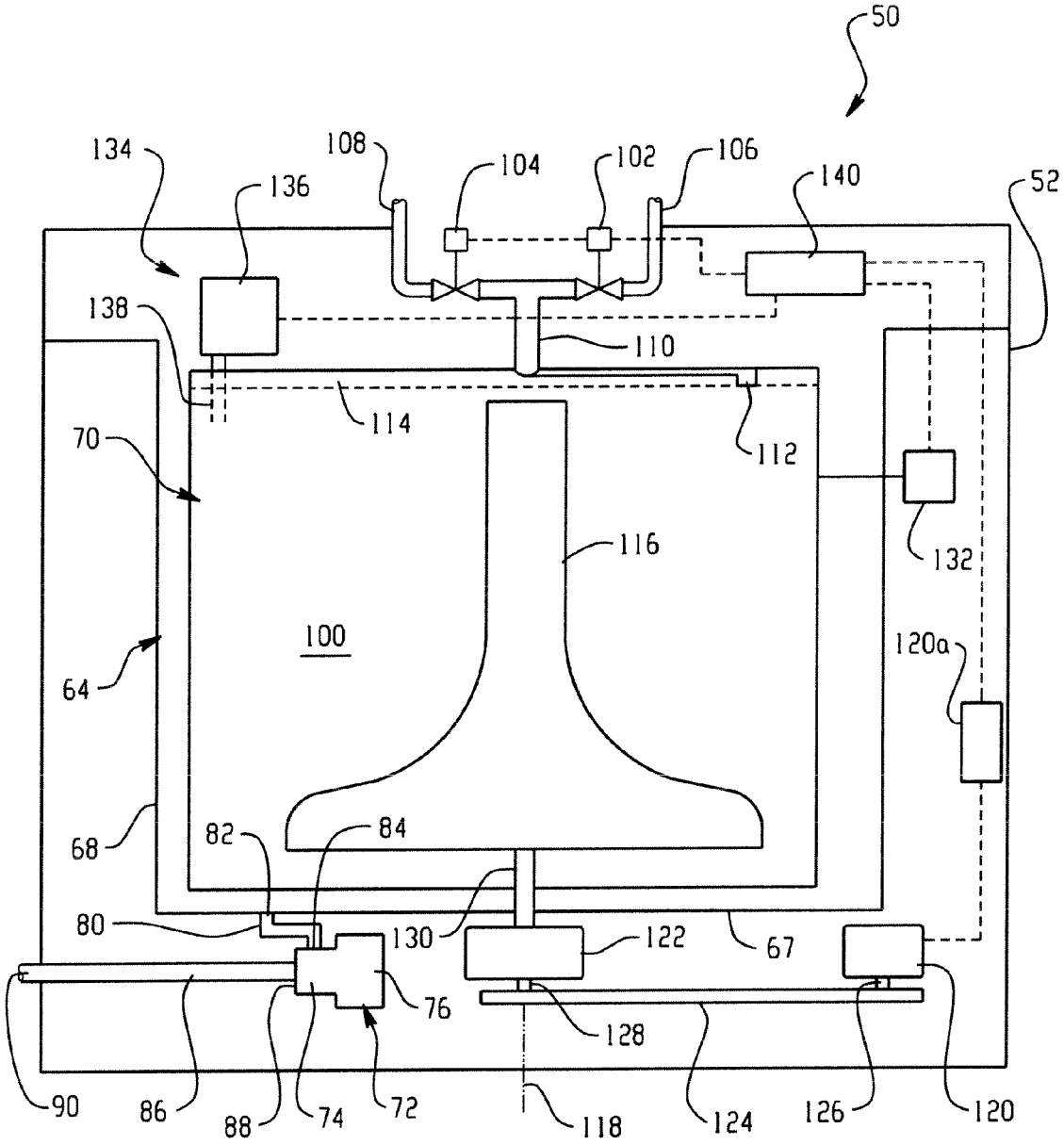
FIG. 2 is an elevational schematic view of the washing machine shown in FIG. 1.

With additional reference to FIG. 2, the wash tub 64 is located or positioned within the cabinet 52, and a wash basket 70 is movably disposed and rotatably mounted within the wash tub 64. As is known and understood by those skilled in the art, the basket 70 can include a plurality of apertures or perforations (not shown) to facilitate fluid communication between an interior 100 of the basket 70 and the wash tub 64. An agitation element 116, such as an agitator, impeller, auger, oscillatory basket mechanism, etc., or a combination of the foregoing, is disposed in the wash basket 70 to impart motion to the articles or wash load within the wash basket 70. In particular, in the illustrated embodiment, the agitation element 116 is a vane agitator rotatably positioned within the basket 70 on vertical axis 118 for imparting motion to articles and liquid received within the basket 70.

The wash tub 64 includes a bottom wall 67 and a side wall 68, the basket 70 being rotatably mounted or supported within the tub 64 in spaced apart relation from the tub bottom wall 67 and the side wall 68. A pump assembly 72 is located beneath the wash tub 64 and the basket 70 for gravity assisted flow when draining the tub 64. The pump assembly 72 includes a pump 74, a motor 76, and in an exemplary embodiment a motor fan (not shown). A pump inlet hose 80 extends from a wash tub outlet 82 in tub bottom wall 67 to a pump inlet 84, and a pump outlet hose 86 extends from pump outlet 88 to an appliance washing machine water outlet 90 and ultimately to a building plumbing system discharge line (not shown) in flow communication with the outlet 90. In operation, pump assembly 72 can be selectively activated to remove liquid from the basket 70 and the tub 64 through drain outlet 90 during appropriate points in washing cycles as machine 50 is used.

A hot liquid valve 102 and a cold liquid valve 104 deliver fluid, such as water, to the basket 70 and the wash tub 64 through a respective hot liquid hose 106 and a cold liquid hose 108. Liquid valves 102,104 and liquid hoses 106,108 together form a liquid supply connection for the washing machine 50 and, when connected to a building plumbing system (not shown), provide a water supply for use in the washing machine 50. Liquid valves 102,104 and liquid hoses 106,108 are connected to a basket inlet tube 110, and fluid can be dispersed from the inlet tube 110 through a nozzle assembly 112 having a number of openings therein to direct washing liquid into basket 70 at a given trajectory and velocity.

In an alternate embodiment, a spray fill conduit 114 (shown in phantom in FIG. 2) can be employed in lieu of the nozzle assembly 112. Along the length of the spray fill conduit 114 can be a plurality of openings (not shown) arranged in a predetermined pattern to direct incoming streams of water in a downward tangential manner towards a wash load in the basket 70. The openings in the conduit 114 can be located a predetermined distance apart from one another to produce an overlapping coverage of liquid streams into the basket 70. The wash load in the basket 70 may therefore be uniformly wetted even when the basket is maintained in a stationary position of course, any other type of nozzle or spray fill conduit could be used in the machine 50.

In an exemplary embodiment, the basket 70 and the agitator 116 are driven by a motor 120 through a transmission and clutch system 122. The motor 120 is driven by an inverter 120*a*. A transmission belt 124 is coupled to respective pulleys of a motor output shaft 126 and a transmission input shaft 128. Thus, as motor output shaft 126 is rotated, transmission input shaft 128 is also rotated. Clutch system 122 facilitates driving engagement of the basket 70 and the agitator 116 through shaft 130 for rotatable movement within the wash tub 64, and clutch system 122 facilitates relative rotation of the basket 70 and the agitator 116 for selected portions of wash cycles. Motor 120, transmission and clutch assembly 122 and belt 124 can collectively be referred to as a machine drive system, the drive system being drivingly connected to the wash basket 70 and the agitator 116 for rotating the basket 70 and/or the agitator 116. As will be appreciated by those of skill in the art, the drive system 120,122,124 of the illustrated embodiment can be replaced by any other suitable drive system.

In one embodiment, as will be described in more detail below, the drive system can be used to accelerate the basket 70 to a desired rotational speed, maintain the basket 70 at a desired rotational speed and then decelerate the basket to a second desired rotational speed. For example, the inverter can be driven in a first direction to rotate the basket 70 in a first rotatable direction. The inverter can then be driven to accelerate rotation of the basket 70 in the first rotatable direction or can be driven to decelerate rotation of the basket 70 to a lesser speed, including zero RPM. Alternatively (or in addition), the washing machine 50 can include a brake assembly (not shown) selectively applied or released for decelerating rotation of the basket 70, maintaining the basket 70 in a stationary position within the tub 64, and/or allowing the basket 70 to spin within the tub 64. The machine 50 can also include a sensor or other device 132 for measuring or monitoring the rotational speed of the basket 70.

In the illustrated embodiment, the washing machine 50 further includes a dispenser 134 mounted in the cabinet 52 for dispensing a laundry additive, such as a detergent, bleach, fabric softener, etc., or any combination of the foregoing, into the wash tub 64 and/or wash basket 70. The dispenser 134 can include a holding compartment 136 for receiving and holding the laundry additive and a nozzle 138 for directing any amount of the laundry additive that is released into the tub 64 and/or basket 70. In one embodiment, the compartment 136 is mounted on an inside wall of the cabinet 52 at an upper portion thereof and can be filled manually when the lid 62 is opened. Alternatively, the dispenser 134 can be provided as part of a bulk dispensing system integrated into the washing machine 50 or any other type of automatic or semi-automatic filling and/or dispensing system. As will be described in further detail below, the dispenser 134 can dispense an amount of laundry additive into the tub 64 and/or basket 70 corresponding to a parameter (e.g., the dry weight) of the wash load held in the basket 70.

Operation of the machine 50 can be controlled by a controller 140. For example, the controller 140 can be operatively connected to the user interface input located on the washing machine backsplash 58 for user manipulation to select washing machine cycles and features. In response to user manipulation of the user interface input, the controller 140 operates the various components of the machine 50 to execute selective machine cycles and features. The controller 140 can also be operatively coupled to the drive system 120,122,124, the nozzle assembly 112 (or alternatively the spray conduit 114), the sensor 132 and/or the dispenser 134.

In one embodiment, as will be described in more detail below, the controller 140 is configured to operate the drive system 120,122,124 to accelerate rotation of the basket 70 to a first speed and then decelerate rotation of the basket 70 from the first speed to a second, lower speed. The controller 140 is further configured, in this embodiment, to measure an amount of time of deceleration from the first speed to the second speed to determine a parameter of the wash load, such as the weight of the wash load, for example. Still further, the controller 140 can be configured to operate the drive system 120,122,124 after washing of a wash load held in the rotatable basket 70 to again accelerate rotation of the basket 70 to the first speed and then decelerate rotation of the basket 70 from the first speed to the second, lower speed. The controller 140 can also be configured to measure another amount of time of deceleration (i.e., a second amount of time) from the first speed to the second speed during this second deceleration, then to correlate the another or second amount of time to a wet weight of the wash load, and then to determine a water retention amount in the wash load by comparing a dry weight of the wash load to the determined wet weight of the wash load.

Figure 3:
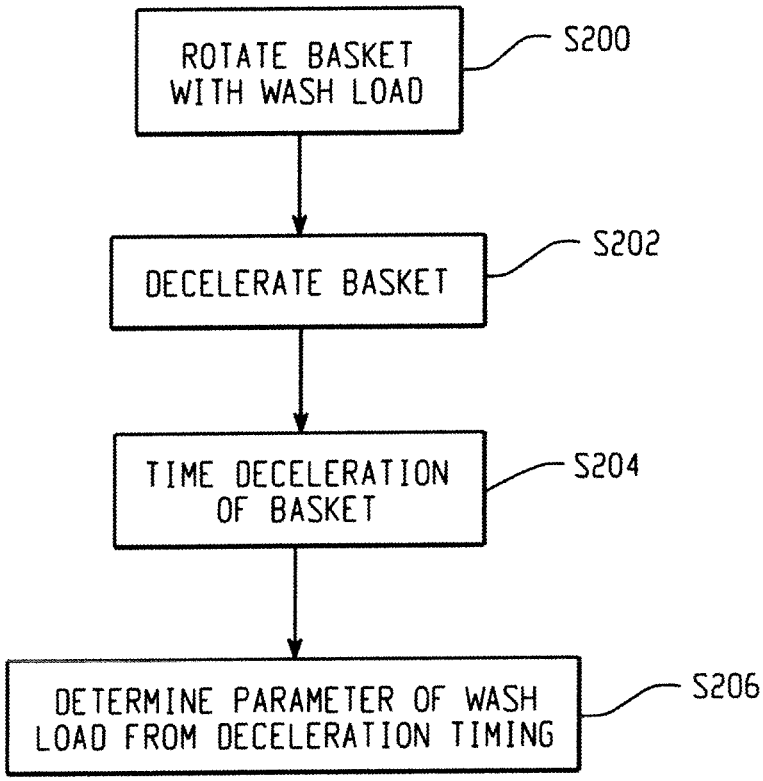
FIG. 3 is a block flow diagram illustrating a method for determining a parameter of a wash load.

Turning now to FIG. 3, a method for determining a parameter of a wash load held in a rotatable basket of a washing machine, such as rotatable basket 70 of washing machine 50, will now be described. First, in step S200, the rotatable basket 70 is rotated to urge the wash load received therein radially outwardly in the basket 70. In a conventional 20" diameter basket, the speed at which the rotatable basket 70 is rotated could be 600 rpm, for example. The specific speed, however, can vary depending on a variety of factors, including the size and material of the basket. The specific speed selected could be one that is most likely to cause the wash load held within the basket 70 to become plastered to the side walls of the wash basket 70. This would provide the largest moment of inertia from a rotational sense for the clothing of the wash load to act on the washing machine 50.

Once the rotatable basket 70 is accelerated to a sufficient speed in step S200, the rotatable basket 70 with its wash load urged radially outwardly is decelerated in step S202 to or below a predetermined threshold speed, such as 0 rpm, for example. In particular, the rotatable basket 70 is decelerated by the fastest means available, by driving the inverter to brake and/or applying braking action from a braking assembly to the rotatable basket 70. The speed to which the rotatable basket 70 is decelerated need not be a particular speed other than being one that is less than the speed from which the rotatable basket is decelerated. For example, the speed could be 100 rpm, 50 rpm, 20 rpm, 0 rpm, etc.

In any case, the deceleration of the basket 70 is timed in step S204. More particularly, in step S204, an amount of time from initial deceleration of the rotatable basket 70 until the rotatable basket 70 is decelerates to the predetermined threshold speed is measured or determined. In step S206, the measured amount of time from step S204 is used to determine at least one parameter of the wash load held in the rotatable basket 70. In one embodiment, the wash load in the rotatable basket 70 is a dry wash load in steps S200-S206 and the parameter of the wash load being determined in step S206 is a load size of the dry wash load in the basket 70. In this example, the measured amount of time from initial deceleration of the rotatable basket 70 until the rotatable basket 70 decelerates to the predetermined threshold speed is correlated to a dry weight of the wash load in the rotatable basket 70 to determine the load size of the wash load. Specifically, the time to change from a higher RPM to a lower RPM is a function of the weight of the clothing inside the basket 70. The heavier the clothing inside the washing machine 50, the longer it takes to achieve the new RPM. Thus, weight of the wash load can be correlated to the load size in the machine.

The correlation may be made via transfer function or a simple look-up table. For example, the correlation can be made via a look up table where y1 and y2 are determined empirically for the desired load size ranges for the particular washing appliance:

| Return | Load Size |
|---|---|
| $t < y1$ | Small |
| $y1 < t < y2$ | Medium |
| $y2 < t$ | Large |

Where:
y1 = Lower Limit
y2 = Upper Limit

As will be described in more detail below, the dry weight or load size of the wash load can be used in a number of applications, including for determining how much of a particular laundry additive to add to the rotatable basket, for use in determining a water retention amount in a particular wash load, etc. As already discussed, the controller 140 is used to control operation of the rotatable basket 70 via the drive system 120,122,124. For example, the controller 140 can rotate the basket 70 via the drive system with its wash load in step S200, decelerate the basket 70 in step S202 and time the deceleration of the basket 70 in step 204. Moreover, in step S206, the controller 140 can determine a parameter of the wash load from the deceleration timing, such as the load size of the wash load held in the rotatable basket 70. For example, the controller 140 can correlate the measured amount of time from step S204 to a dry weight of the wash load to determine the load size.

Figure 4:
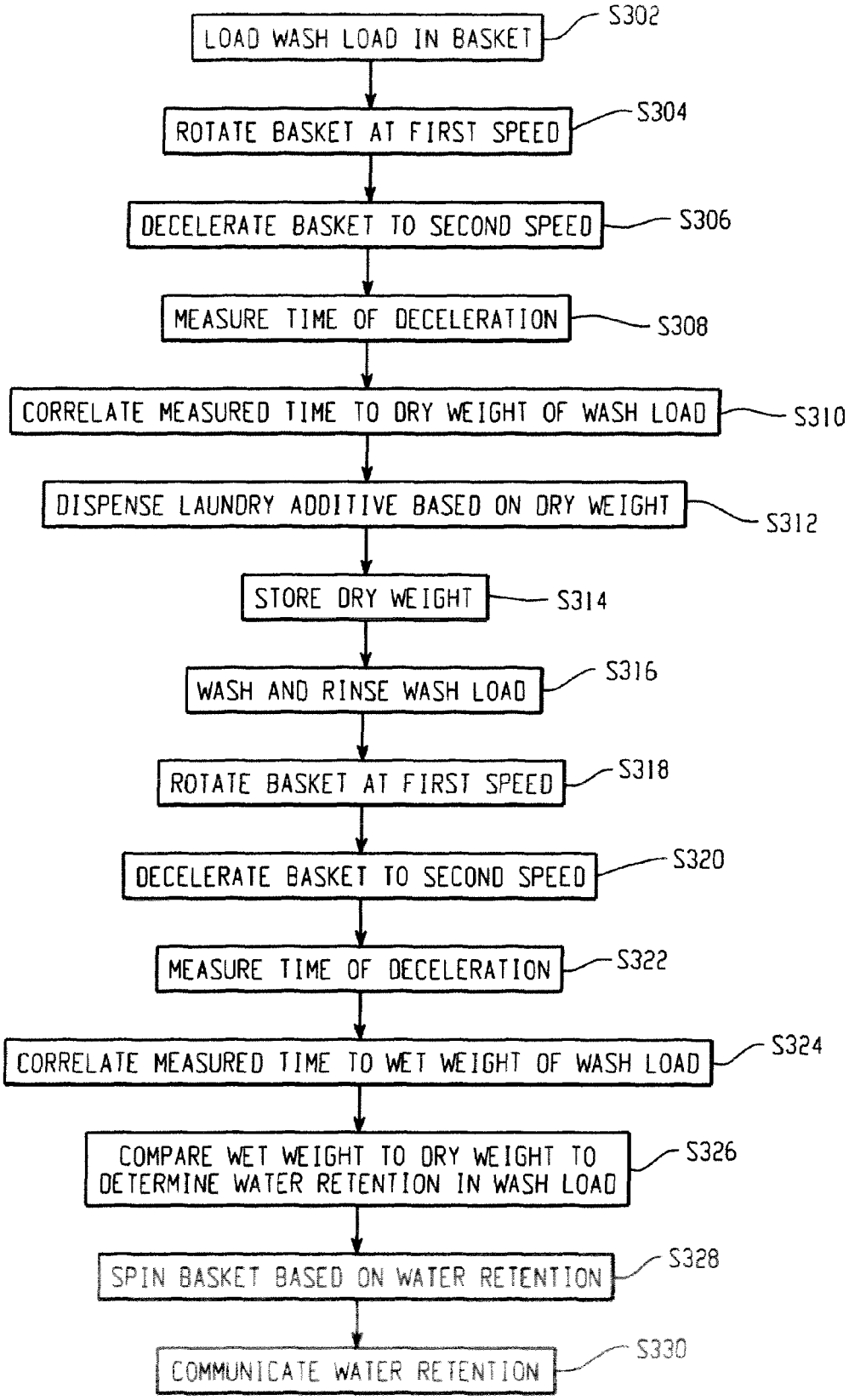
FIG. 4 is a block flow diagram illustrating a method for determining a load size of a wash load and a water retention amount of the wash load.

With reference now to FIG. 4, the method of FIG. 3 is used first to determine a dry weight of a wash load (one parameter of the wash load) and used again later in a wash cycle to determine a wet weight of a wash load, which can be compared to the dry weight to determine an amount of water retention in a wash load (a second parameter of the wash load). More particularly, the method of FIG. 4 includes loading the wash load in the basket 70 (S302). Next, the rotatable basket 70 with the wash load held therein is accelerated or rotated to or then rotated at a first speed sufficient to urge the wash load radially outwardly against the radial sides of the wash basket 70 (S304), which in one exemplary embodiment is 700 RPM. After the wash load is urged radially outward in S304, the rotatable basket 70 with the wash load urged radially outwardly therein is decelerated from the first speed of S304 to a second, lower speed, which in one exemplary embodiment is zero RPM. However, as described in reference to S202 of FIG. 3, the second, lower speed can be any speed less than the first speed of S304, such as 200 rpm, 100 rpm, 50 rpm, 20 rpm, 10 rpm, 0 rpm, etc. The controller 140 directs rotation of the basket 70 in S304 and S306 via the drive system 120,122,124, and optionally a braking assembly.

In S308, the amount of time of the deceleration in S306 is measured, such as by the controller 140. More particularly, an amount of time of deceleration of the rotatable basket 70 is measured from the first speed to the second speed. The measured amount of time of the deceleration can then be correlated by the controller 140 to a weight of the wash load (S310). More particularly, when the wash load and the rotatable basket 70 has not yet been wetted (e.g., from the nozzle assembly 112 or spray fill conduit 114), the measured amount of time from S308 can be correlated to a dry weight of the wash load, the dry weight being a metric of the load size of a particular wash load in the rotatable basket 70.

In the particular method illustrated in FIG. 4, the dry weight determined in S310 can be used in connection with the dispensing of laundry additive into the rotatable basket 70. More particularly, in S312, an amount of laundry additive can be dispensed into the rotatable basket 70, wherein the amount of laundry additive corresponds to the determined load size from S310. In an exemplary embodiment, the laundry additive could be detergent, bleach, fabric softener or any combination of the foregoing. The laundry additive is received in the holding compartment 136 and at the appropriate time dispensed through the nozzle 138 by the controller 140 with the particular amount of the laundry additive dispensed through the nozzle 138 regulated by the controller 140 to correspond to the dry weight of the wash load in the rotatable basket 70.

The following table provides values (e.g., in milliliters) for additive to dispense for small, medium and large loads depending on the concentration of additive being used. The values reflect the normal recommended amount of additive at each level, and are not adjusted based on consumer preference.

| Load Size | Conc | Normal |
|---|---|---|
| Small | 1 | 17.33 |
| | 2 | 8.66 |
| | 3 | 6.79 |
| | 4 | 5.10 |
| | 5 | 4.08 |

-continued

| Load Size | Conc | Normal |
|---|---|---|
| Medium | 1 | 30.34 |
| | 2 | 15.17 |
| | 3 | 11.90 |
| | 4 | 8.92 |
| | 5 | 7.14 |
| Large | 1 | 45.49 |
| | 2 | 22.74 |
| | 3 | 17.84 |
| | 4 | 13.38 |
| | 5 | 10.70 |

In an illustrative example, the lower limit y1=6.65 seconds and the upper limit y2=7.55 seconds. The look-up table could be as follows:

| Return | Load Size |
|---|---|
| t < 6.65 | Small (1-4 lbs) |
| 6.65 < t < 7.55 | Medium (4-8 lbs) |
| 7.55 < t | Large (8+ lbs) |

In the event the appliance returned a value of 6.40 seconds to change the RPM of the drum "A" rpm's to "B" rpm's, the appliance would assume a load size of "small" corresponding to 1 to 4 lbs. The table could have fewer or more different interval settings than three, for example, the intervals may be 0-2 lbs, 2-4 lbs, etc. The threshold time limits and the combinations and sensitivity levels of the look-up table are determined empirically, based on the parameters of the particular appliance design and the desired precision. Alternatively, or in addition, the dry weight can be used in other functions of the washing machine 50 (e.g., for determining how much fill water to deliver).

In the method of FIG. 4, the dry weight determined in S310 can be stored for later use (S314). Next, an S316, the wash load is washed and rinsed, which causes the wash load to become a wet wash load. As is well known, water is applied to the wash load via the nozzle assembly 112 or the spray fill conduit 114. After the wash load is washed and spun, the rotatable basket can again be rotated at a first predetermined speed to urge the wet wash load radially outwardly in the basket 70 (S318). In the illustrative embodiment, this speed is the same as the first predetermined speed for the dry load, 700 RPM. However, the first predetermined speed for the wet load need not be the same. From the first speed, the controller 140 can decelerate the basket 140 to a second speed (S320) less than the first speed. In the illustrative embodiment, this second speed zero RPM, just as for the second speed utilized in the dry weight determination, however, a different value could be used as well. Like S308, the controller 140 can measure the time of deceleration (S322). More particularly, a second amount of time can be measured by the controller 140 from the first speed in S318 to the second speed in S320. The measured second amount of time in S322 can then be used to determine another parameter of the wash load, which can be, for example, the wet weight of the wash load and ultimately the amount of water retained in the wash load in the same manner as the dry weight of the wash load was determined.

In particular, the controller 140 can correlate the measured second amount of time from S322 to a wet weight of a wash load in the rotatable basket 70.

| Return | Residual Moisture Content |
|---|---|
| t-S314 < t1 | (0-2 lbs) |
| t1 < t-S314 < t2 | (2-4 lbs) |
| t2 < t-S314 | (4+ lbs) |

The wet weight determined in S324 can then be compared by the controller 140 to the dry weight determined in S310 and stored in S314 to determine the amount of water retained in the wash load in the basket 70 (S326). Specifically, the controller 140 can subtract the dry weight from the determined wet weight of the clothing to determine the amount of moisture in the wash load. Exemplary uses of the water retention determination include determining how long to further spin the wash load to further remove water retained therein (S328) and/or communicating the water retention amount to another appliance, such as a dryer, for facilitating selection of the most appropriate dryer settings to best handle drying of the wash load when the same is removed from the washing machine 50 and added to an associated dryer (not shown). More specifically, in S328, the rotatable basket 70 can be spun after the amount of water retained in the wash load is determined and the period of time for which the rotatable basket 70 is spun can correspond to the amount of water retention, as determined in S326, in the wash load. In S330, a determined amount of water retention from S326 can be communicated to an associated dryer for facilitating settings of the dryer for drying the wash load.

It should be appreciated from the foregoing that the method of FIG. 4 allows for the automatic determination of the load size of a wash load in washing machine 50 before introduction of water into or onto the wash load. The method can also enable the washing machine 50 to determine, without the consumer's input, the proper amount of laundry additive to be dosed based on a determined load size. Still further, the method of FIG. 4 can enable the washing machine 50 to determine accurately the moisture content in the wash load. This can be used for efficient use of energy, for example determining a precise of time the rotatable basket 70 should be spun and/or for informing an associated dryer of the determined moisture content, which allows the dryer to prepare for ideal dryer settings.

The exemplary embodiment or embodiments have been described with reference to preferred embodiments. Obviously, modifications and alterations will occur to others upon reading and understanding the preceding detailed description. It is intended that the exemplary embodiments be construed as including all such modifications and alterations insofar as they come within the scope of the appended claims or the equivalents thereof.

What is claimed is:

1. A method for determining parameters of a wash load held in a rotatable basket of a washing machine, comprising:

rotating the rotatable basket to a first speed to urge a dry wash load radially outwardly in the basket;

decelerating the rotatable basket with the dry wash load urged radially outwardly to or below a second predetermined threshold speed;

measuring an amount of time from initial deceleration of the rotatable basket from the first speed until the rotatable basket decelerates to said second predetermined threshold speed;

determining a load size of the dry wash load by using said measured amount of time including correlating said measured amount of time to a dry weight of the dry wash load, and determining a load size of the dry wash load based on the correlated dry weight;

storing said dry weight of the dry wash load for use later in a wash cycle;

washing and rinsing the dry wash load which causes the dry wash load to become a wet wash load;

after washing and rinsing the wet wash load, rotating the rotatable basket to urge the wet wash load radially outwardly in the basket;

decelerating the rotatable basket with the wet wash load urged radially outwardly to or below the second predetermined threshold speed;

measuring a second amount of time from initial deceleration of the rotatable basket from the first speed with the wet wash load therein until the rotatable basket decelerates to said second predetermined threshold; and determining an amount of water retained in the wet wash load based on the measured second amount of time, including (i) correlating said measured second amount of time to a wet weight of the wet wash load, (ii) comparing said wet weight and said dry weight, and (iii) determining said amount of water retained in the wet was load.

2. The method of claim 1 further including:

dispensing an amount of laundry additive into the rotatable basket, as a function of said determined load size.

3. The method of claim 1 wherein said second predetermined threshold is equal to said first predetermined threshold.

4. The method of claim 1 further including washing and spinning the wet wash load prior to rotating and decelerating the rotatable basket, and wherein using said measured amount of time includes correlating said measured amount of time to a wet weight of the wet wash load and comparing said wet weight to a dry weight of the dry wash load to determine said amount of water retention in the wet wash load.

5. The method of claim 4 further including:

spinning the rotatable basket after said amount of water retention in the wet wash load is determined for a period of time established as a function of said amount of water retention in the wet wash load.

6. The method of claim 4 further including:

communicating said determined amount of water retention in the wet wash load to an associated dryer to facilitate settings of the dryer for drying the wet wash load.

7. The method of claim 1 further comprising using at least one of the correlated wash load weight and the wet weight of the wet wash load to efficiently use energy in determining how long to spin the wet wash load to remove water retained therein.

8. The method of claim 1 further comprising transmitting at least one of the correlated wash load weight and the wet weight of the wet wash load to a dryer to facilitate selection of an efficient dryer setting to dry the wash load.

9. A method for determining load size of a wash load in a washing machine, comprising:

rotating a rotatable basket first time with a dry wash load held therein at a first speed to urge said dry wash load radially outwardly;

decelerating said rotatable basket with said dry wash load urged radially outwardly from said first speed to a lower, second speed;

measuring an amount of time of deceleration of said rotatable basket with said dry wash load from said first speed to said second speed;

correlating said measured amount of time to a weight of said dry wash load;

then introducing water into the rotatable basket to cause the dry wash load to become a wet wash load;

rotating the rotatable basket a second time with the wet wash load held therein at a third speed to urge said wet wash load radially outwardly;

decelerating said rotatable basket with said wet wash load urged radially outwardly from said third speed to a fourth, lower speed;

measuring a second amount of time of deceleration of said rotatable basket from said third speed to set fourth speed;

determining an amount of water retained in the wet wash load based on the measured second amount of time, including (i) correlating said measured second amount of time to a wet weight of the wet wash load, (ii) comparing said wet weight and said weight of said dry wash load and (iii) determining said amount of water retained in the wet wash load; and dispensing a predetermined amount of laundry additive into the basket corresponding to a determined load size of the wash load in response to the correlating step.

10. The method of claim 9 further comprising using at least one of the correlated wash load weight and the wet weight of the wet wash load to efficiently use energy in determining how long to spin the wet wash load to remove water retained therein.

11. The method of claim 9 further comprising transmitting at least one of the correlated wash load weight and the wet weight of the wet wash load to a dryer to facilitate selection of an efficient dryer setting to dry the wash load.

* * * * *